US005515624A

United States Patent [19]

Beatty

[11] Patent Number: 5,515,624

[45] Date of Patent: May 14, 1996

[54] EXCAVATING HOE OR BUCKET

[75] Inventor: Robert A. Beatty, Brisbane, Australia

[73] Assignee: R. A. Beatty & Associates Pty Limited, Queensland, Australia

[21] Appl. No.: 187,466

[22] Filed: Jan. 28, 1994

[30] Foreign Application Priority Data

Oct. 15, 1992 [AU] Australia ..... 5284

[51] Int. Cl.[6] ..... E02F 3/60

[52] U.S. Cl. ..... 37/399; 37/316; 37/397

[58] Field of Search ..... 37/394, 395, 496, 37/396, 397, 398, 399, 400, 401, 264, 379, 444, 341, 445, 903, 461, 446, 449, 427, 436, 439, 442, 418, 316, 315, 314; 172/734, 799.5, 811, 815, 701.1, 701.3

[56] References Cited

U.S. PATENT DOCUMENTS

| | | | |
|---|---|---|---|
| 74,857 | 2/1868 | Sink | 37/315 |
| 121,227 | 11/1871 | Baker | 37/316 |
| 122,423 | 1/1872 | Williams | 37/316 |
| 210,448 | 12/1878 | Bridges | 37/341 X |
| 266,402 | 10/1882 | Townsend | 37/341 |
| 351,264 | 10/1886 | Hoyt | 37/316 |
| 373,646 | 11/1887 | Cook | 37/316 |
| 589,047 | 8/1897 | Thomas | 37/315 X |
| 885,049 | 4/1908 | Holcomb | 37/444 |
| 929,355 | 7/1909 | Webster | 37/316 |
| 990,232 | 4/1911 | Cross | 37/444 |
| 1,001,700 | 8/1911 | Snow | 37/316 |
| 1,104,154 | 7/1914 | Stinson | 37/316 |
| 1,413,944 | 4/1922 | Sockwell | 37/316 |
| 1,457,594 | 6/1923 | Neary | 37/400 X |
| 1,473,890 | 11/1923 | Toy | 172/811 |
| 1,480,192 | 1/1924 | Worsfold | 37/314 X |
| 1,560,895 | 11/1925 | Crowe | 37/396 |
| 1,646,536 | 10/1927 | Housman | 37/398 X |
| 1,782,497 | 11/1930 | Anderson | 37/316 |
| 1,792,592 | 2/1931 | Lewis | 37/316 |
| 1,824,989 | 9/1931 | Fundom | 37/398 |
| 1,887,117 | 11/1932 | Colley | 37/395 |
| 1,979,738 | 11/1934 | Gibson | 37/398 |
| 2,013,276 | 9/1935 | Luce | 37/394 |
| 2,501,489 | 3/1950 | Aisthorpe | 37/398 |
| 2,588,657 | 3/1952 | Pitts | 37/398 |
| 2,648,918 | 8/1953 | Mazzella | 37/341 X |
| 2,684,549 | 7/1954 | Olden | 37/316 X |
| 2,864,182 | 12/1958 | Russell | 37/394 |
| 3,247,607 | 4/1966 | Page | 37/399 |
| 3,394,483 | 7/1968 | Taglioli | 37/316 X |
| 3,767,070 | 10/1973 | Arnold | 214/146 R |
| 3,768,571 | 10/1973 | Renfroe | 37/341 X |
| 3,795,070 | 3/1974 | Bronson et al. | 37/466 |
| 3,947,980 | 4/1976 | Andrews et al. | 37/314 |
| 4,028,821 | 6/1977 | Hanks | 37/394 X |
| 4,184,958 | 1/1980 | Manchak, Jr. | 37/400 X |
| 4,446,637 | 5/1984 | Ferreira | 37/316 |
| 4,731,941 | 3/1988 | Beatty | 37/394 |
| 4,779,363 | 10/1988 | Boutrais et al. | 37/405 |

*Primary Examiner*—Randolph A. Reese
*Assistant Examiner*—Victor Batson
*Attorney, Agent, or Firm*—Nixon & Vanderhye

[57] ABSTRACT

An excavating hoe or bucket includes a hoe or bucket body which is movable across an excavation area, and a structure for providing the hoe body or bucket body with a variable load capacity. The variable load capacity may be provided by a network of flexible line members such as chains, which may be disconnected from each other and reattached at different attachment or insertion locations, to increase or decrease the load capacity of the hoe or bucket.

33 Claims, 7 Drawing Sheets

FIG. 1
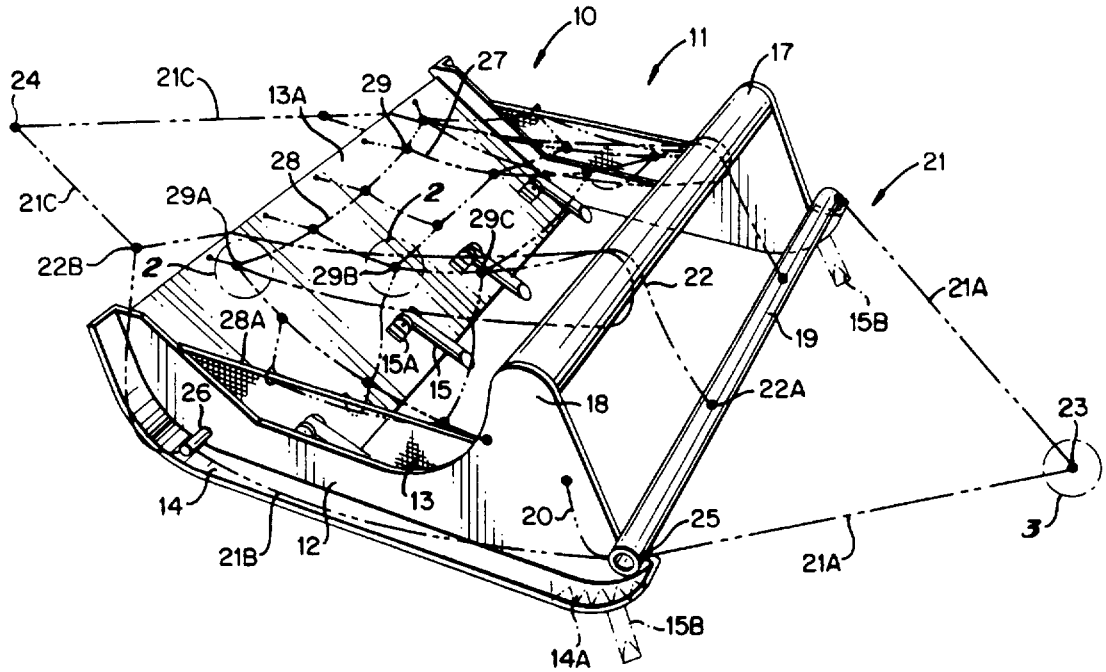
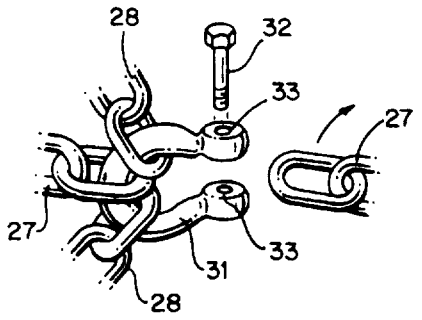
FIG. 2
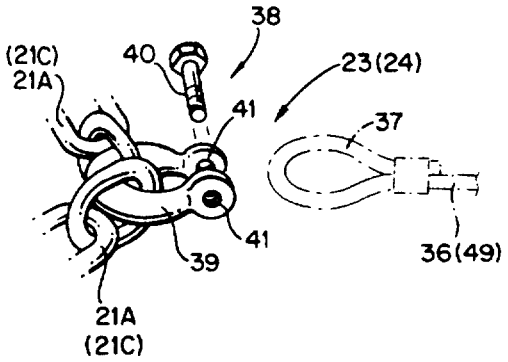
FIG. 3

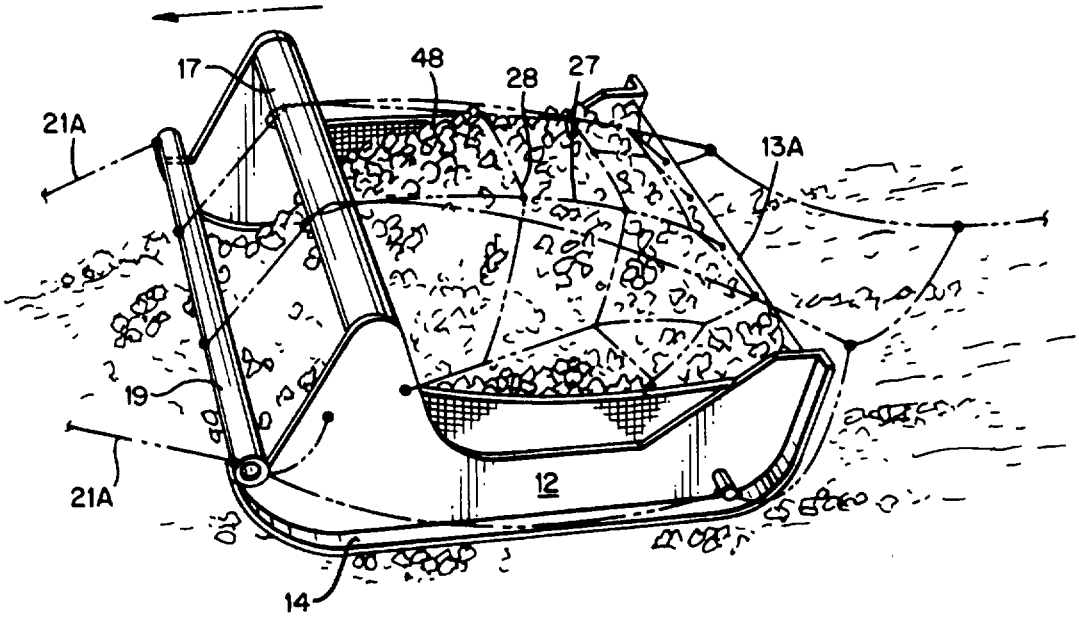
FIG. 7
FIG. 8
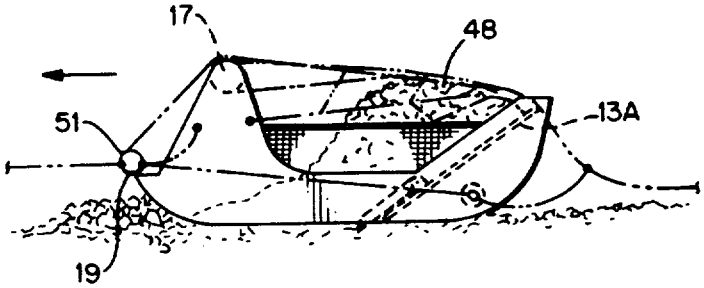
FIG. 9
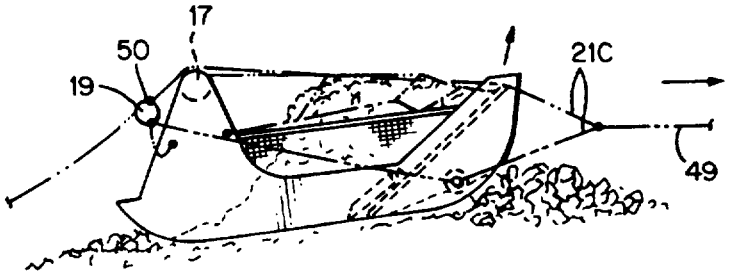

FIG. 12
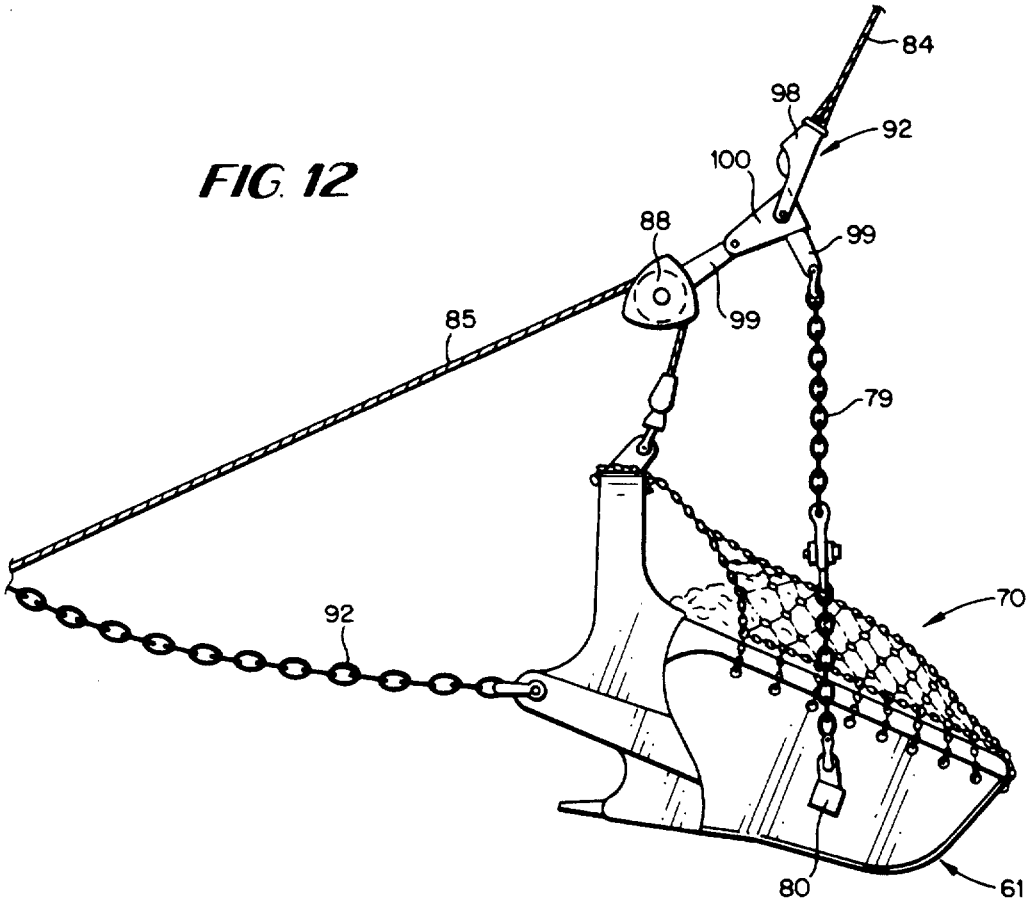
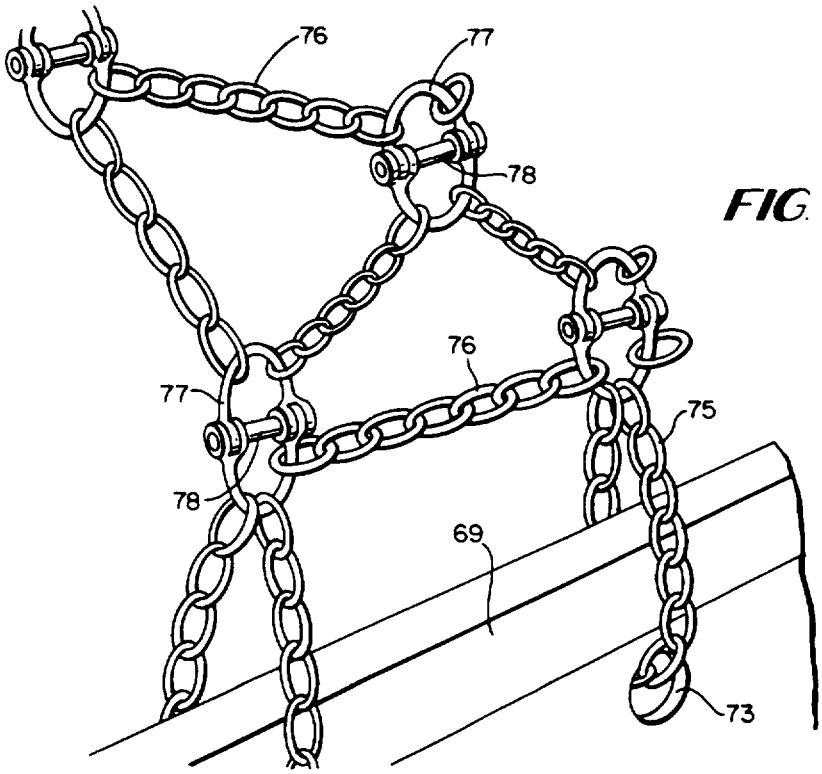
FIG. 13

EXCAVATING HOE OR BUCKET

FIELD OF INVENTION

This invention relates to an excavating hoe or bucket which may be used in excavating excavation areas. The excavating hoe or bucket in particular may be used in mining applications such as clearing overburden from an accessible coal or mineral deposit or for land reclamation purposes or far excavating a mineral deposit at the surface of an underground mine.

BACKGROUND OF THE INVENTION

An excavating hoe which may be utilised in mining applications such as for clearing overburden from an accessible coal or mineral deposit has been described in Australian Patent 567437 (ie. which corresponds to U.S. Pat. No. 4,731,941). This prior art excavating hoe includes an upper body frame, a scraper blade pivotally attached to a rear end of the body frame, means for connecting the hoe to one or more draglines for moving the hoe in a forward direction and means for connecting the hoe to a tail line for moving the hoe in a rearward direction. The body frame has generally horizontally disposed top means for floating the body frame on a load of scraped material advanced by the scraper blade and the body frame has side means for loading and/or retaining the load of scraped material advanced by the scraper blade. In operation the scraper blade was pivoted to a material scraping position when the hoe was traversed in a forward direction and was reversely pivoted to a non-operative position when the hoe was traversed by the tail line in a reverse direction.

A conventional excavating hoe or bucket which may also be used in conventional draglines is also described in Australian Patent 576437.

Conventional draglines include a dragline housing which incorporates a hoist winch, an outwardly extending boom carrying a hoist cable connected to the hoist winch which may extend downwardly from an outer end of the boom attached to an excavator bucket as hereinafter described and a drag cable attached to the excavator bucket which is connected to a drag winch located in the dragline housing. Both the drag winch and hoist winch are suitably driven from electric motors and the dragline housing is suitably rotatably mounted to a support base by a central bearing. The dragline housing may be equipped with crawler tracks for locomotion or alternatively and more commonly is equipped with a walking mechanism having a pair of support feet which are reciprocatable relative to the dragline housing and thus may propel the dragline housing in a desired direction of travel.

The excavator bucket is usually arcuate in shape having a base and peripheral wall provided with an open front or access mouth whereby soil or overburden may gain access to the interior of the bucket as the bucket is dragged or moved through loose overburden by the drag cable(s). A plurality of ripper teeth along a free edge of the base may be provided in the open front or access mouth.

A rear end of the excavator bucket is provided with a pair of opposed support chains each attached to a respective support lug on the external face of the upper side wall. The chains may be interconnected by a horizontal bar.

There also may be provided a support loop or arch adjacent the open front of the bucket to which may be attached support cable(s) connected to the hoist cable(s) and also to the drag cable(s) by use of an appropriate sheave mechanism. There also may be provided a pair of drag chains attached to support lugs below the support arch.

The abovementioned conventional dragline operates to remove overburden or to mine a mineral from a valuable mineral or coal deposit such as a coal seam. After initially drilling and blasting the overburden by a suitable explosive such as ammonium nitrate, the overburden is loosened and softened. A bulldozer was then used to level a portion of the overburden to provide a flattened hill for supporting the dragline housing. The excavator bucket was then moved to the desired location wherein the drag winch was free spinning so that the drag cable was slack. In this movement the hoist winch has enough tension to hold the excavator bucket as it swings freely when suspended from the boom. Then the excavator bucket is placed on the ground by actuation of the hoist cable and tension is subsequent applied to the drag cables. The bucket is subsequently dragged through the loose overburden until it is full. The tension is then maintained in the drag cables and tension is applied to the hoist cables to elevate the full bucket above the overburden. By balanced control of me hoist winch and drag winch the bucket may then be moved towards the top of the boom which has a sheave for supporting the hoist cable. The dragline housing is then rotated away from the excavation site towards a spoil pile or dump from the overburden in the bucket and is tipped out of the excavator bucket by slackening of the tension in the drag cables. By appropriate control of the hoist cable the empty excavator bucket then assumes its normal orientation and is then moved back to the excavation site by rotation of the dragline housing.

While the abovedescribed excavating hoe or dragline bucket was generally satisfactory in operation, it was considered that operating efficiency of the hoe or bucket could be improved and one example of such efficiency was to provide an improved excavating hoe or bucket which could transport a greater load per unit of drag force.

SUMMARY OF THE INVENTION

It therefore is an object of the invention to provide an excavating hoe or bucket which may be more efficient in operation than the prior art referred to above.

In one aspect of the invention there is provided an excavating hoe or bucket comprising a body which is movable across an excavation area and means for providing the body with a variable load capacity.

In one form of the invention the hoe body itself may be motorised and thereby have ground engaging wheels driven by a motor mounted on the hoe body.

In another form of the invention there may be provided connection means for connection of the hoe body to a prime mover for movement of the hoe body in the first traverse and/or said second traverse. However while it is possible to utilise a common connection means in this regard (e.g. having reference to the motorised hoe body discussed above) it is preferred that the connection means utilized between the prime mover and the hoe body in the first traverse (i.e. a primary connection means) is different to the connection means utilized between the hoe body and the prime mover in the second traverse which may constitute the secondary connection means.

Suitably the primary connection means may be a drag cable attachable to a drag chain assembly of the hoe body as hereinafter described. In this regard the secondary connection means may comprise a tail cable attachable to a tail chain assembly as hereinafter described.

The prime mover to which the hoe body may be connected or supported may be of any suitable type. As referred to above one type of prime mover may be a motorised hoe body. In another form a prime mover may be a high wall winch or low wall winch referred to in Patent 567437 or a bulldozer or other vehicle capable of hauling a load.

The hoe body may be provided with one or more skid members for supporting skidding or slidable movement of the hoe. Preferably them are provided skid members on each side of the hoe and in one suitable embodiment the hoe may be provided with a pair of opposed side walls with each side wall being supported by a respective skid member. Each skid member may comprise an elongate plate having a smooth undersurface with the elongate plate comprising an upwardly forward part, an intermediate part of substantially planar orientation and a rear part which may also be upwardly curved in a direction of opposite taper to me forward part. This means in a preferred form each skid member in side elevation may comprise a shallow U shape.

In another embodiment there may be provided a ripping blade located at a forward end of the or each skid member. The incorporation of such a ripping blade has the advantage of providing additional scarifying action as well as providing side wall clearance when the excavating hoe of the invention is used in trench cutting operations.

In another embodiment the hoe body may be provided with alternative means to facilitate movement of hoe such as wheels or an appropriate undercarriage having wheels or skid members attached.

If desired each side wall may be formed from flexible material such as a flexible net or other suitable fabric such as canvas or flexible plastics material. This may comprise one form of the variable capacity load means described above. However, it is more preferred that each side wall comprises a lower rigid component of rigid material such as metal or plastic and an upper component of flexible material. The incorporation of the flexible material in each side wall has the advantage of reduction of metal or plastics and thus may be considered as a cost cutting measure or a means to reduce the tare weight of the hoe. However, if appropriate each side wall may be formed entirely from rigid material.

The hoe body may also include one or more transverse body members interconnecting the opposed side walls. In one embodiment there may be provided a front transverse member such as a rod or bar interconnecting each side wall. The provision of the transverse member(s) reinforces or stabilises the hoe body. If desired there also may be provided a rear transverse member such as a rod or bar interconnecting each side wall.

The hoe body has a variable load capacity and this may be contributed to in one example at least partly by each side wall being formed entirely or partly from flexible material as discussed above. The hoe body may also have a top wall formed from flexible material or alternatively have a network of line members such as cords, cables or chains which may be utilised to retain the bulk of a load within the hoe body upon movement of the hoe. Preferably at least some of the line members may be disconnected from each other and reattached at different attachment or intersection locations to increase or decrease the load capacity as may be required.

The hoe may also include a rigid excavating blade or transverse excavating wall attached to or integral with the hoe body. Preferably the rigid blade is formed as a plate of metal or plastics material and is integral with each side wall of the hoe. Preferably the rigid blade is oriented at an angle of 30°–40° to a horizontal plane normal to a longitudinal axis of the hoe as descried hereinafter in the preferred embodiment. If desired the rigid blade may include a plurality of blade plates releasably attached to each other so that removal or addition of one or more plate(s) may also vary the load capacity of the hoe. The blade may also be provided with a bottom edge which may be substantially flush with or extend below the level of the skid members.

There also may be provided a plurality of protrusions pivotally attached to the rigid plate so as to assist in keeping the material of the load pressurized and the ground being traversed by the excavating hoe in a scarified condition. The pivoted protrusions which may be in the form of ripper tines or ripper teeth also facilitate the feeding of additional load material into the hoe. The protrusions are pivoted so as not to obstruct a return traverse of the hoe if required. Preferably the plurality of pivoted protrusions are unevenly spaced so that new ground may be broken up or scarified upon succeeding traverses.

In another embodiment the protrusions may be rigidly attached to the rigid plate or alternatively the protrusions may be dispensed with and the bottom edge of the rigid plate may function to excavate material. The protrusions be they rigidly or pivotally mounted may be located at or adjacent to the bottom edge of the rigid plate.

The excavating hoe may also be provided with a drag bar which is pivotally attached to the hoe body at a front end of the hoe whereby when the hoe is being towed or dragged in a first or forward traverse the drag bar may be located in a lower drag position when the hoe is undergoing a forward traverse. In this embodiment the drag bar may be attached to one or more drag cables which may be attached to a prime mover.

However when the hoe is undergoing a second or return traverse the drag bar may be pivoted upwardly from a drag position to a non-operative position to avoid any obstruction to movement occasioned through possible contact with the discharging load.

In relation to an excavator or dragline bucket, such a bucket may also be provided with a variable load capacity which may be formed in one example by a side wall of the bucket being formed entirely or partly from flexible material as discussed in relation to the hoe body. The bucket may also have a top wall formed from flexible material or alternatively have a network of line members such as cords, cables or chains which may be utilised to retain the bulk of a load within the bucket upon movement of the bucket. Preferably as discussed above in relation to the hoe body at least some of the line members may be disconnected from each other and re-attached at different attachment points or intersection locations to increase or decrease the load capacity as may be required.

BRIEF DESCRIPTION OF THE DRAWINGS

Reference may now be made to a preferred embodiment of the invention as shown in the attached drawings wherein:

FIG. 1 is a perspective view of an excavating hoe constructed in accordance with the invention;

FIGS. 2 and 3 are detailed views of parts of FIG. 1 labelled "**29*a*" and "23**";

FIG. 7 is a perspective view of the excavating hoe of FIG. 1 in a forward traverse;

FIG. 8 is a side view of the excavating hoe of FIG. 7;

FIG. 9 is a side view of the excavating hoe of FIG. 7 in a reverse or return traverse;

FIG. 12 is a side view of the bucket shown in FIG. 11;

FIG. 13 is a detailed view of the attachment of the top wall formed by flexible chains to the body of the bucket.

DETAILED DESCRIPTION OF THE DRAWINGS

Figure 4:
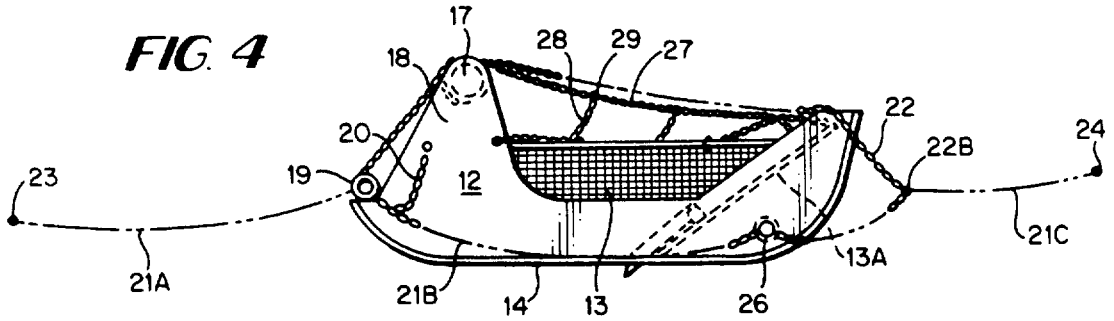
FIG. 4 is a side view of the excavating hoe shown in FIG. 1.

In the drawings there is shown the hoe 10 including body 11 including a pair of opposed side walls 12 together with a flexible net part 13 co-extensive with each side wall 12 which may be used to save metal in regard to each side wall 12. The hoe body 11 also a slide or skid 14 integral with each side wall 12. The hoe body also includes a tapered traverse wall 13A provided with a plurality of teeth or tines 15 pivotally attached to tapered wall 13 by pivot joint 15A. It is also preferred that each tine 15 be unevenly spaced across tapered wall 13A as shown.

There is also provided a transverse rod 17 which is located at the front of hoe body 11 and which also interconnects each side wall 12 at raised projections 18. Rod 17 is also responsible for maintaining the structural integrity of body hoe 11.

Adjacent to transverse rod 17 is located a movable drag bar 19 which is attached to hoe body 11 by attachment chains 20 at each end of rod 19. There is provided chains 21 which comprise a drag chain component 21A, an intermediate component 21B and tail chain component 21C. There is also provided longitudinal chains 22 which interconnect drag bar 19 to tail chains 21C.

There is also provided a top network of longitudinal body chains 27 and transverse body chains 28 which intersect at locations 29. Locations 29 may form a releasable coupling as shown in detail in FIG. 2 where chains 27 and 28 are interconnected by a U shaped coupling 31 and releasable pin 32 screw threadedly engageable in aligned apertures 33 of U shaped coupling 31. Drag chains 21A form a junction at 23 to provide a hitch point for connection to a drag cable 36 shown in FIG. 3 which may be attached to a prime mover e.g. low wall winch component as described in Australian Patent 576437. Tail chains 21C merge or form a junction at 24 which provides a hitch point for connection to a tail chain 49 shown in FIG. 9 attached to a high wall winch component as described in Australian Patent 576437. The junction of chains 21A and 21B are formed by an adjacent end of drag bar 19 as shown at 25 and the junction of chains 21B and 21C are constituted by projection 26 extending outwardly from each side wall 12. Projection 26 transfers the drag force from the drag cable 36 or tail cable 49 to the hoe 10. Longitudinal chains 22 are attached to drag bar 19 at 22A and connect with an adjacent chain 21C at 22B.

There is also provided a flexible top part of hoe 10 which may comprise the top network of chains 27 and 28 as described above. The capacity of hoe 11 may be varied if desired by changing the location of interconnection between chains 27 and 28 from position 29 as described above to position 29B or 29C for example which may form similar releasable couplings as shown in FIG. 2.

In FIG. 3 there is shown a hitch joint 23 between drag cable 36 having loop 37 which engages with releasable coupling 38 which interconnects each drag line 21A. Releasable coupling 38 includes U shaped coupling 39 and releasable pin 40 which may be screw threadedly engaged in aligned apertures 41 of U shaped coupling 39. The hitch joint 24 may also be formed in a similar manner.

Figure 5:
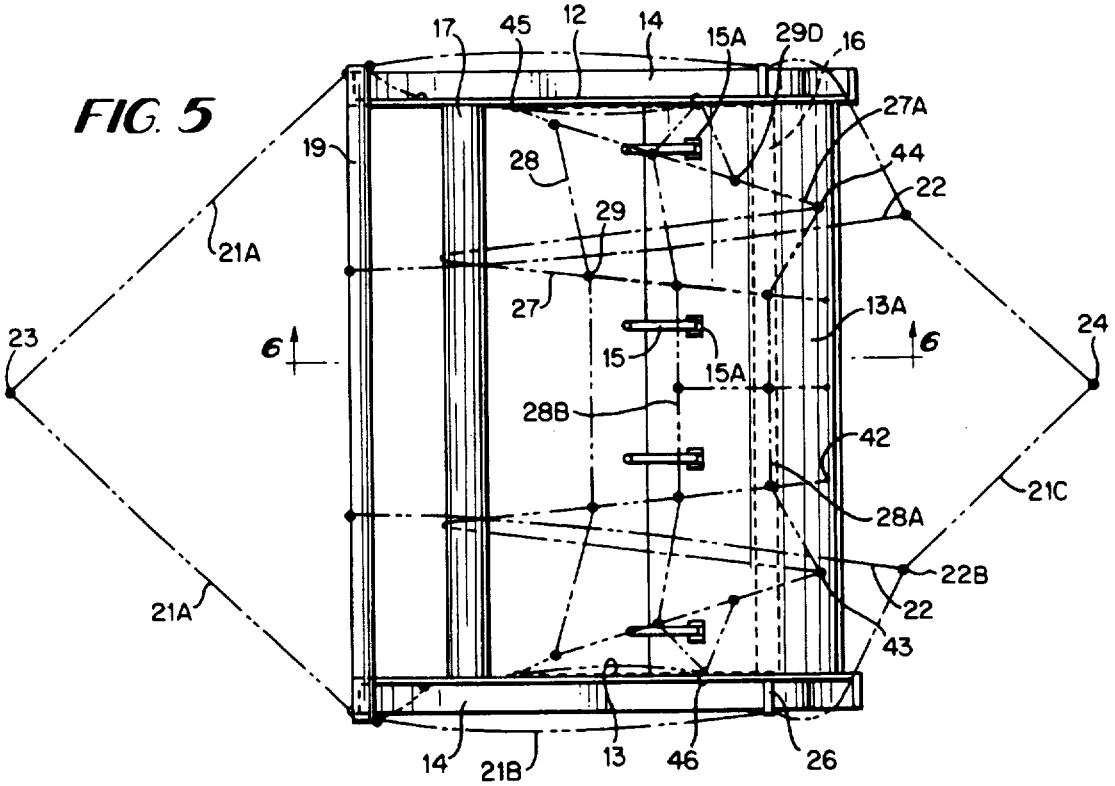
FIG. 5 is a top plan view of the excavating hoe shown in FIG. 1.
Figure 6:
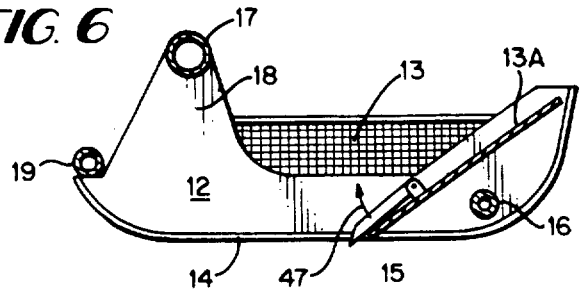
FIG. 6 is a sectional view through FIG. 4 along the line depicted by A—A.

FIGS. 4, 5 and 6 show alternative views of hoe 10 as described above. There is also shown rear stabiliser bar 16 which also maintains the structural integrity of hoe body 11 and the network or grid formed by chains 27 and 28. Stabiliser bar 16 may not be required if transverse wall 13A is rigidly attached to side plates 12. Each chain 27 as shown is attached to transverse wall 13A at 42 and extends around transverse rod 17 before being re-attached to transverse wall 13A at 43. There is also provided longitudinal chains 27A which are attached to transverse wall 13A at 44 and also to an associated side wall 12 at 45 before forming transverse chains 28A. Transverse chain 28B may also be attached to side walls 12 at 48 before being attached to chain 27A at 29D. This arrangement is shown clearly in FIG. 5. In FIG. 6 the arrow 47 indicates the direction of pivotal movement of each tine 15.

The operation of hoe 10 is now described in regard to FIGS. 7, 8 and 9. In FIG. 7 the hoe 10 is being dragged through loose overburden 48 with tension being exerted on drag lines 21A by either a bulldozer or low wall winch component as described above. The hoe in its forward traverse as shown in FIG. 7 is efficient in that it may obtain high payload to tare weight efficiency in transporting overburden which may be alluvial overburden or alternatively hard rock that has been previously drilled and shot. The position of the drag bar 19 is shown and the network of chains 27 and 28 maintain the load within the confines of the hoe 10. The overburden compacts in advance of rear blade or wall 13A as shown in FIG. 8. In FIG. 9 upon a return traverse of hoe 10 tension is exerted upon drag chains 21C by drag cable 49 and drag bar 19 is pulled upwardly as shown to a non-operative position 50 when compared to the operative position 51 shown in FIGS. 7 and 8.

It will be appreciated that the load capacity of hoe 10 may also be varied by passing chains 27 underneath transverse rod 17 instead of over and under the transverse rod 17 as illustrated in FIGS. 1–9.

It will also be appreciated that the drag bar 19 may be omitted if required and instead a pair of drag chains or towing lines may be attached to hoe body 11 to each side wall 12 at projection 26.

If desired additional protrusions 15B shown in phantom in FIG. 1 may be provided on the bottom edge (not shown) of each side plate 12 at a front end thereof. Also if desired each skid plate 14 may be provided with a serrated ripper blade 14A at a front end thereof. Blades 14A may be utilised for shaving a side bank (not shown).

It is also preferred that the overall length of the side walls 12 relative to the vertical height of the transverse wall 13A be approximately in the ratio 3:1 and that the width of the rigid transverse wall 13A relative to the length of side walls 12 is around 1:1.15.

Other desirable structural features of the hoe as shown in the preferred embodiment in FIGS. 1–9 are (i) Transverse rod 17 is a cylindrical pipe structure. This facilitates running a loaded hoe 10 on top of a previously dumped load, because the cylindrical transverse rod 17 also acts as a skid which permits the front of the hoe to ride up.

(ii) The width of the skid plates 14 at the front of the hoe 10 should not be too narrow as narrower skids will tend to dig in under some ground conditions and cause the hoe to somersault.

(iii) The side plates 12 are preferably on a slight taper 0.5° flare, wider at the front to assist with unloading the hoe. A greater flare angle may lead to steering difficulties.

(iv) The front drag bar 19 is connected to the tail cables 21C so that the bar lifts over the discharging load when the hoe returns backwards. The limit chain 20 on either side prevents the bar from over riding the top of the hoe.

(v) The mesh panels 13 on the side plates are installed to eliminate spillage and reduce hoe tare weight.

(vi) The rippers 15 are installed ahead of the blade 13A and the blade 13A is preferably set level with the lowest level of skids 14. This arrangement permits the rising load from rippers 15 to be caught by the blade 13A, and eliminates the need to swing the blade clear for the return trip.

(vii) The rippers 15 are also required to loosen the base material, ready for the next loading trip. Without this scarifying action the spoil may pack down after several hoe runs, and it becomes difficult to load the hoe properly. The rippers 15 are preferably unevenly spaced along the blade 13A to reduce the prospect of the same ripping path being duplicated each run. The rippers 15 can be replaced by fixed teeth protruding from the cutting edge of the blade, but this results in more wear on the ripping teeth, and a more pronounced back blading effect—leading to a lower stripping efficiency. Hinged ripper shanks are therefore preferred.

(viii) The blade 13A angle is set at 35°. This was found to be desirable because steeper blade angles may cause the hoe 10 to ride up over the retained load, or require extra dead weights on the back to effect penetration, while shallower blade angles may not unload properly.

(ix) The top chain net comprising chains 27 and 28 is designed to form a web to retain and compact the load. It also forces the hoe to skid on an underlying shear plane when full. This reduces the required pulling force. The chain web ensures a full load each time, and also assists with unloading the hoe. The main web support chains 27, passing to the front support cylinder 17, can be adjusted in length to alter the size of the retained load. Shortening these chains reduces the load size. A hoe operating on an up hill run will generally retain more material than one operating on a down slope, although operating on steep down slopes can cause mass movement of material which increases the effective load size.

(x) The chain web as described is considered to be the most efficient load retaining configuration. Extra chains should be added to the web if significant leakage is evident when operating in varying soil types.

(xi) Limit chain 20 also permits the hoe to be installed on a dragline machine suitable for use in spoil reclamation tasks in that the hoist rope is cable 49 and the drag rope is cable 36 and the limit chain 20 prevents the hoe overturning when it is placed for digging. It therefore will be appreciated that the term "excavating hoe" can also include within its scope a dragline bucket of the type commonly used with draglines as described in Patent 576437 which may be modified in accordance with the invention.

(xii) Projection 26 is ideally placed at a low position near the cutting edge of me blade to maintain maximum hoe stability during loading operations.

It will therefore be appreciated that the hoe of the invention having regard to the illustrated embodiment will be more efficient in operation than the prior art excavating hoe discussed above especially in relation to volumetric load efficiency being the proportion of payload to hoe tare weight.

In another aspect of the invention there may be provided a hoe body provided with ground engaging wheels which may be driven by any appropriate means such as a motor or engine supported on the hoe body. This may comprise a suitable example of the "prime mover" referred to above for moving the hoe in a forward or reverse direction. However, more preferably there is also utilised a low wall winch for moving the hoe in a Forward traverse which is described in Australian Patent 567437. In this embodiment the motorised hoe body is used for moving the hoe body in a second or reverse traverse.

Figure 10:
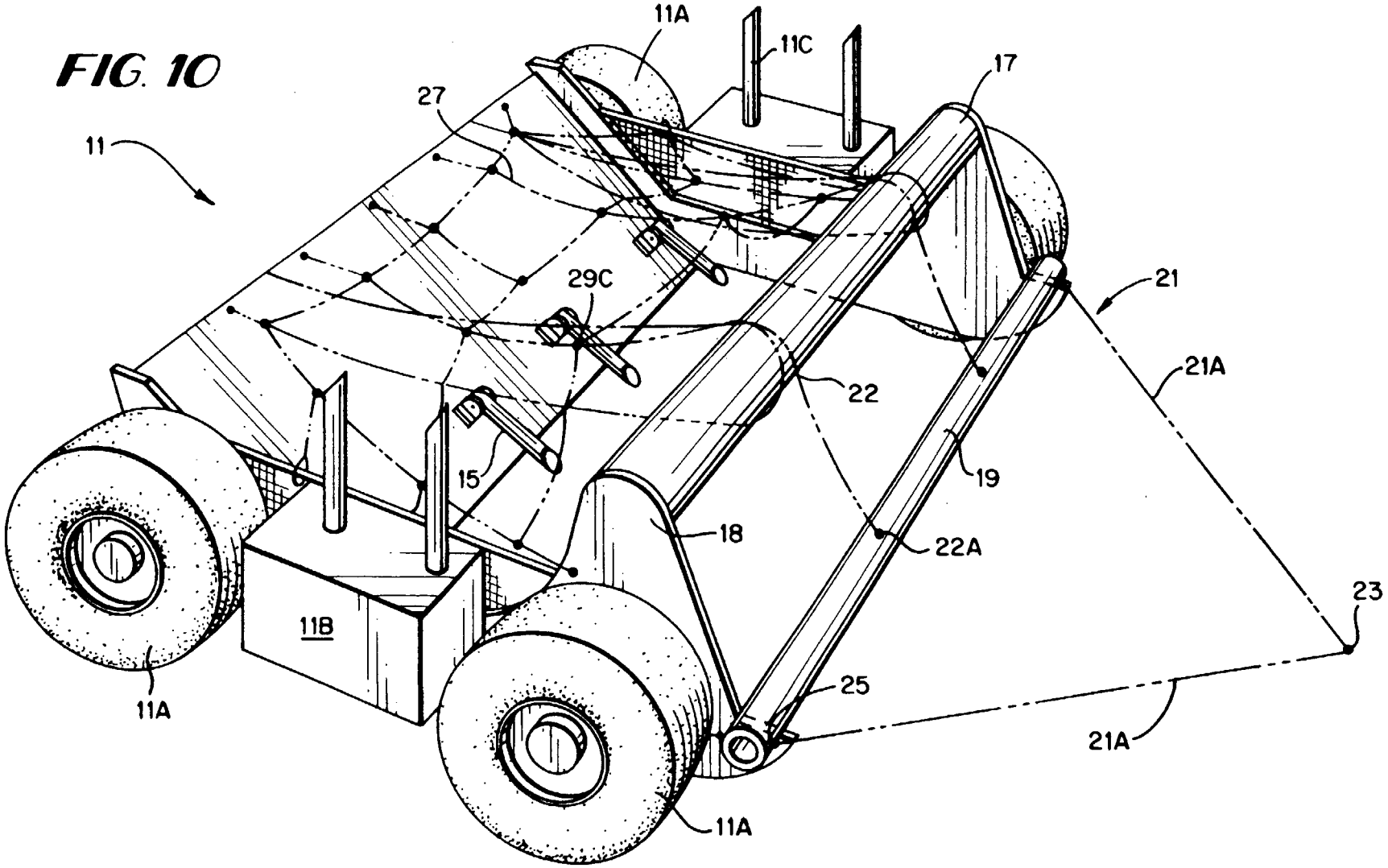
FIG. 10 is a perspective view of a motorized excavating hoe constructed in accordance with the invention.

This aspect of the invention is shown in FIG. 10 wherein the hoe body 11 is provided with ground engaging wheels 11A which are driven by engine 11B provided with exhaust pipes 11C. It will of course be appreciated that engine 11B which may be an internal combustion engine may run on petrol or other suitable fuel such as diesel. Alternatively, the engine 11B may be replaced by an electric motor connected by leads to a suitable power source.

The low wall winch (not shown) may be attached by suitable drag cable(s) (not shown) to hitch joint 23. In this embodiment the trail cable(s) 21C and 49 may be omitted.

It will be appreciated that the terms "front" and "rear" used herein in regard to the hoe body have reference to the first or forward traverse of the hoe body. The angle of inclination of traverse blade 13A is in a direction rearwardly of the longitudinal axis of the hoe body using the first or forward traverse as a reference datum as shown in the drawings.

Figure 11:
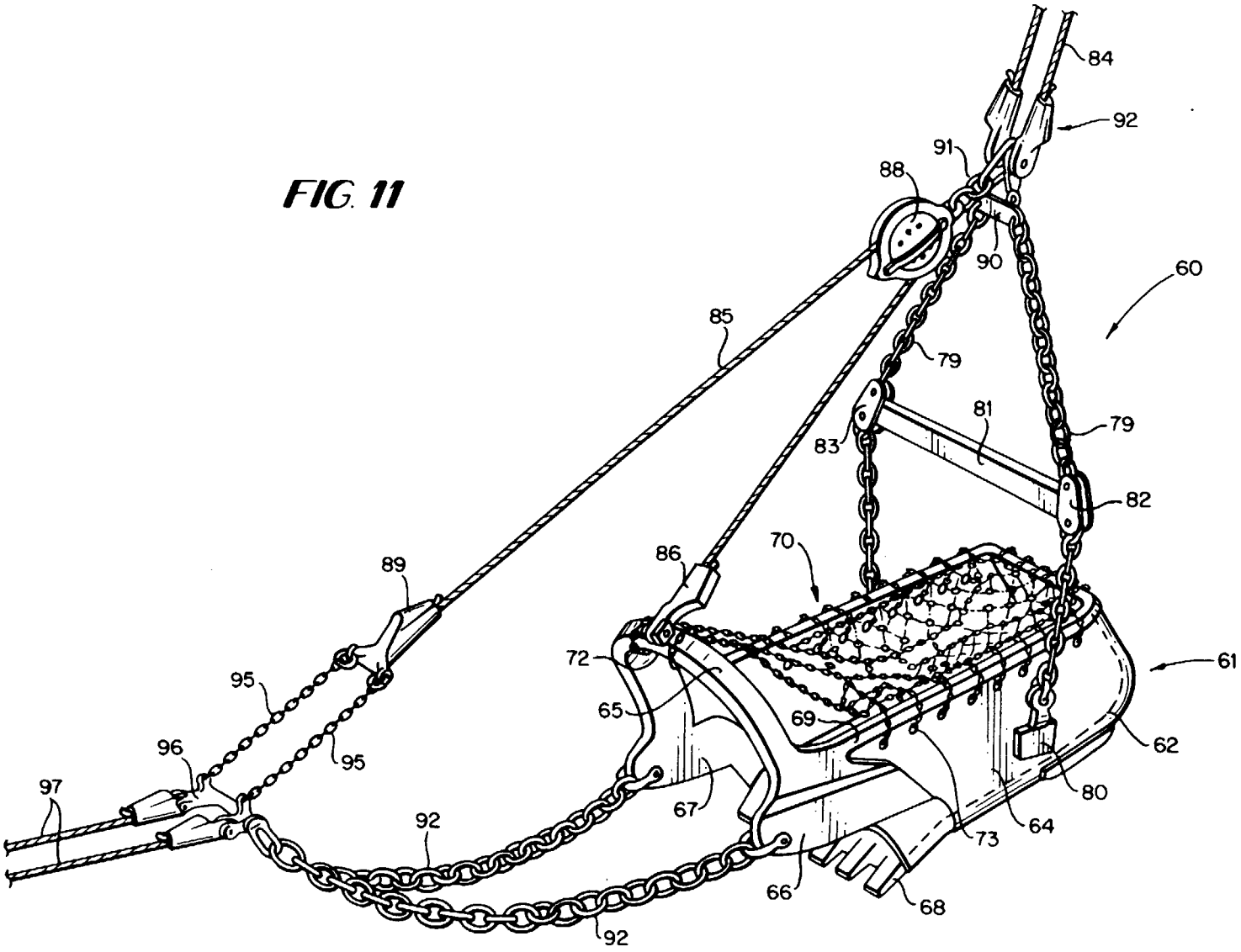
FIG. 11 is a perspective view of one form of dragline bucket constructed in accordance with the invention.

In FIGS. 11–13 reference is made to a dragline bucket assembly 60 having a body 61 which includes a peripheral wall 62 and a bottom wall 64. The bucket 60 also has a front arch or support loop 65 which is co-extensive with support lugs 66. There is also provided an open mouth 67 and ripper teeth 68. There is also provided a reinforcing strip or rail 69 associated with peripheral wall 62. The bucket 60 is also provided with a top net 70 comprising a network of chains which are attached to front arch 65 at 72 and which are also attached to peripheral wall 62 by being looped around reinforcing strip 69 and passing through apertures 73 as best shown in FIG. 13. The network of chains comprises longitudinal chains 74 attached to front arch 65, peripheral chains 75 looped through apertures 73 and intermediate chains 76 connected by adjacent shackles 77. Each shackle 77 includes a releasable connection bolt 78.

The dragline bucket 60 also includes opposed support chains 79 attached to peripheral wall 62 by support lugs 80, spreader bar 81, connected to support chains 79 at 82 and 83, hoist cables 84, support cable 85 attached at one end to front arch 65 by support lug 86 which cable is also attached to sheave 88 and at its other end to support bracket 89, top spreader 90, chain 91 interconnecting sheave 88 to joint assembly 92 which interconnects hoist cables 84 and support cables 79, drag cables 92, intermediate cables 95, interconnecting support bracket 89 and bracket 96. The bracket 96 also interconnects drag chain 92 and drag ropes 97.

FIG. 12 shows dragline bucket assembly 60 in an operative load carrying position supported by hoist cables 84 and support chains 79 with net 70 retaining a load within body 61, Both chain 91 and drag chains 92 are slack as shown. As shown in FIG. 12 joint assembly 92 includes support bracket 98 for cables 84, links 99, and connector bracket 100. Support cable 85 may adjust the tilting angle of the body 61 by co-operation with shave 88.

Figure 14:
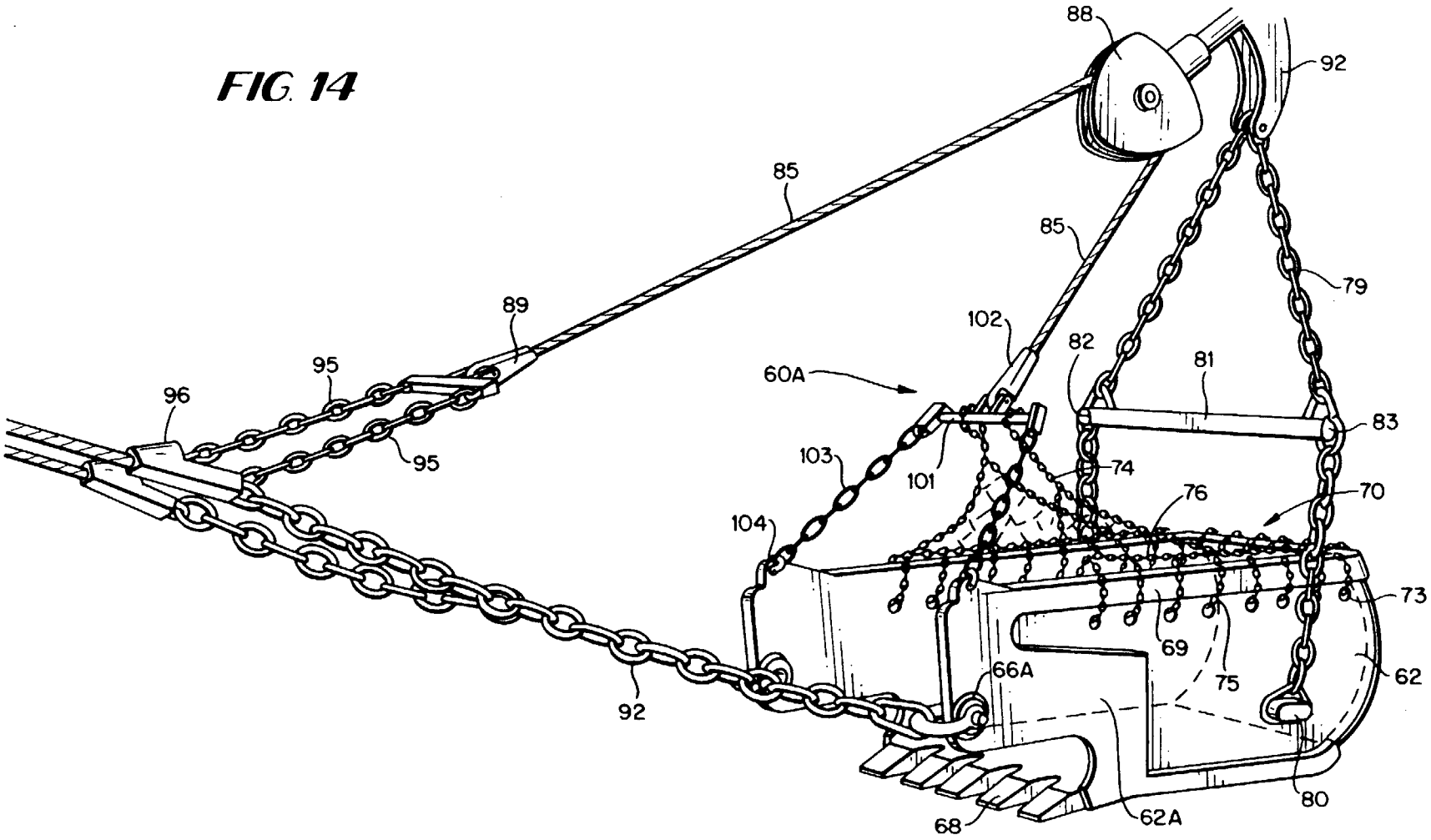
FIG. 14 is a perspective view of another type of dragline bucket constructed in accordance with the invention.

In FIG. 14 reference is made to another type of dragline bucket assembly 60A commonly known as an "archless" type bucket which incorporates a top net 70. Similar reference numerals are used as for dragline bucket 60 shown in FIGS. 11–13. The peripheral side wall 62 includes a thickened or reinforced front part 62A to which drag cables are attached at 66A. The top net 70 is attached to bucket 60A in a similar fashion as described before in FIGS. 11–13. Support cable 85 is attached to a front spreader bar 101 by a bracket assembly 102. Longitudinal chins 74 are looped around spreader bar 101 as shown. There is also provided attachment cables 103 interconnecting spreader bar 101 to body 61A which are attached thereto at 104.

The advantages of application of top net 70 to dragline bucket assemblies 60 and 60A have already been described above in relation to the excavator hoe under advantage (ix) and are mainly directed to retain and compact the load carried by the dragline bucket.

I claim:

1. An excavating hoe or bucket comprising:

a body which is movable across an excavation area, said body having a pair of solid side walls and an open mesh top wall attached to said pair of side walls, said top wall comprising a network of flexible line members adapted to retain a load within the body upon movement of the hoe or bucket, wherein said flexible line members are independently movable and adjustable relative to each other to provide a variable load capacity to the hoe or bucket.

2. An excavating hoe as claimed in claim 1 wherein the body is provided with one or more skid members for supporting slidable or skidable movement of the hoe body.

3. An excavating hoe as claimed in claim 2 wherein there are provided skid members on each side of the body.

4. An excavating hoe as claimed in claim 3 wherein each skid member comprises an upwardly curved leading part, an intermediate part of planar configuration and a trailing part which is upwardly curved in a direction of opposite taper to the leading part.

5. An excavating hoe as claimed in claim 4 wherein the upwardly curved leading part is provided with a ripper blade at a front end thereof.

6. An excavating hoe as claimed in claim 3 wherein each skid member includes an elongate plate having a smooth undersurface.

7. An excavating hoe or bucket as claimed in claim 1 wherein the body is provided with a rigid excavating transverse rear blade or transverse wall having a lower end adjacent an open bottom of the body and said blade or wall having an upper end adjacent the network of flexible line members.

8. An excavating hoe as claimed in claim 7 wherein the rigid transverse blade or wall is provided with a plurality of protrusions extending outwardly therefrom.

9. An excavating hoe as claimed in claim 8 wherein the protrusions are pivotally mounted to the rigid transverse blade or wall adjacent a lower edge thereof and mounted to said blade or wall in such manner so as to avoid obstructing a return traverse of the hoe body.

10. An excavating hoe as claimed in claim 7 wherein the transverse blade or wall is oriented rearwardly of a horizontal plane normal to a longitudinal axis of said hoe body using a forward traverse as a reference datum and at an angle of 30°–40° to said horizontal plane in side elevation.

11. An excavating hoe as claimed in claim 7 wherein the rigid blade or wall is provided with a plurality of blade plates releasably attached to each other to vary the load capacity of the hoe.

12. An excavating hoe or bucket as claimed in claim 1 wherein the hoe body has a pair of side walls formed at least partly from flexible material.

13. An excavating hoe or bucket as claimed in claim 12 wherein each side wall has a lower component of rigid material and an upper component of flexible material.

14. An excavating hoe as claimed in claim 12 wherein a bottom edge of each side wall is provided with one or more scarfying protrusions at a front end of each side wall.

15. An excavating hoe as claimed in claim 1 wherein the hoe body is provided with one or more transverse members to stabilize the hoe body.

16. An excavating hoe as claimed in claim 15 wherein there is provided a rigid transverse bar located at a leading end of the hoe body.

17. An excavating hoe as claimed in claim 1 wherein the hoe body is provided with connection means to a prime mover for movement of the hoe body.

18. An excavating hoe as claimed in claim 17 wherein said connection means comprises primary connection means for connection of the body to the prime mover for movement in a first traverse and secondary connection means for connection of the body to the prime mover for movement in a second traverse.

19. An excavating hoe or bucket as claimed in claim 1 wherein at least some of the line members may be disconnected from each other and reattached at different attachment or intersection locations to increase or decrease the load capacity as may be required.

20. An excavating hoe as claimed in claim 1 wherein the body is provided with one or more ground engaging wheels.

21. An excavating hoe as claimed in claim 1 wherein there is provided a drag bar pivotally attached to the body at a front end thereof whereby when the body is being towed or dragged in a first traverse the drag bar is located in a lower drag position and the drag bar is pivoted upwardly from the lower drag position when the hoe is undergoing a second traverse.

22. A dragline bucket having a solid peripheral wall, an open mouth and a solid base wall and a top wall comprising a network of flexible lines for retaining a load within the bucket upon movement thereof, wherein said flexible lines are independently movable and adjustable relative to each other to provide a variable load capacity to the bucket.

23. A dragline bucket as claimed in claim 22 wherein at least some of the line members may be disconnected from each other and reattached at different attachment or intersection locations to increase or decrease the load capacity as may be required.

24. A dragline bucket as claimed in claim 23 wherein said line members are chains interconnected by releasable shackle joints.

25. A dragline bucket as claimed in claim 22 further including a front arch support to which said flexible top wall is also attached.

26. A dragline bucket as claimed in claim 22 wherein said top wall is also attached to a front spreader bar used in conjunction with support cables or chains.

27. An excavating hoe comprising a body which is movable across an excavation area; and a rigid excavating transverse blade associated with the body having a plurality of protrusions extending outwardly therefrom which are unevenly spaced across the length of the transverse blade or wall.

28. An excavating hoe as claimed in claim 27 wherein the protrusions are pivotally attached to a lower edge portion of said rigid transverse blade or wall.

29. An excavating hoe or bucket comprising:

a body which is movable across an excavation area having top wall comprising a network of flexible line members adapted to retain a load within the body upon movement of the hoe or bucket, wherein said flexible line members are independently movable and adjustable relative to each other to provide a variable load capacity to the hoe or bucket;

wherein the body is provided with a rigid excavating transverse blade or transverse wall;

wherein the rigid transverse blade or wall is provided with a plurality of protrusions extending outwardly therefrom, and wherein the protrusions are unevenly spaced.

30. A dragline bucket having a peripheral wall, an open mouth and a base wall and also incorporating a top wall formed from flexible material which is attached to said peripheral wall;

wherein the top wall is formed from a network of flexible line members utilized to retain a load within the hoe body upon movement of the hoe;

wherein at least some of the line members may be disconnected from each other and reattached at different attachment or intersection locations to increase or decrease the load capacity as may be required;

wherein said line members are chains interconnected by releasable shackle joints, and wherein said chains are attached to a reinforcement rail of the peripheral wall by being looped through attachment apertures located below said reinforcement rail.

31. An excavating hoe comprising a body having a pair of solid side walls, an open mesh top wall attached to the side walls with adjustable attachments to vary the load capacity of the hoe and a rigid excavating blade having a plurality of blade plates releasably attached to each other to vary the load capacity of the hoe and wherein the body is movable across an excavation area.

32. An excavating hoe having a body which is movable across an excavation area and which body comprises a flexible top wall, an open bottom, and a rigid excavating blade oriented rearwardly of a horizontal plane normal to a longitudinal axis of the body using a forward transverse as a reference datum and at an angle of 30°–40° to said horizontal plane in side elevation, and said blade having a lower edge adjacent a rearward end of the open bottom and an upper edge adjacent the flexible top wall.

33. An excavating hoe or bucket having a body movable across an excavation area, having solid side walls, an open bottom and an open mesh top wall comprising a network of flexible lines including peripheral line members releasably attached to the side walls, said network of flexible lines adapted to retain a load within the body upon movement of the hoe or bucket, and a plurality of said lines being independently movable and adjustable relative to other lines to provide a variable load capacity, and said blade having a lower edge adjacent a rearward end of the open bottom on an upper edge adjacent the flexible top wall.

* * * * *